US007025189B1

(12) United States Patent
Petrusan et al.

(10) Patent No.: US 7,025,189 B1
(45) Date of Patent: Apr. 11, 2006

(54) SUPPLY DETECTING DEVICE FOR MONEY OR EQUIVALENTS

(75) Inventors: Mircea Sorin Petrusan, Chicago, IL (US); Michael J. Sciortino, Arlington Heights, IL (US)

(73) Assignee: Glenview Systems Inc., Glenview, IL (US)

( * ) Notice: Subject to any disclaimer, the term of this patent is extended or adjusted under 35 U.S.C. 154(b) by 258 days.

(21) Appl. No.: 10/639,880

(22) Filed: Aug. 13, 2003

(51) Int. Cl.
*G07F 9/06* (2006.01)

(52) U.S. Cl. ..... 194/215

(58) Field of Classification Search ..... 453/16, 453/17, 58; 235/2, 7 R; 194/215, 216, 217, 194/239, 240; 221/6
See application file for complete search history.

(56) References Cited

U.S. PATENT DOCUMENTS 4,219,740 A * 8/1980 Little ..... 307/116
4,285,351 A * 8/1981 Nyffenegger ..... 453/17
5,498,958 A * 3/1996 Tu et al. ..... 324/207.16
5,947,257 A * 9/1999 Schwartz ..... 194/224
6,626,749 B1 * 9/2003 Neborsky et al. ..... 453/17

* cited by examiner

*Primary Examiner*—Donald P. Walsh
*Assistant Examiner*—Mark Beauchaine
(74) *Attorney, Agent, or Firm*—Mathew R.P. Perrone, Jr.

(57) ABSTRACT

A supply detecting device for money or equivalents capable of determines the presence thereof within a closed container.

19 Claims, 6 Drawing Sheets

SUPPLY DETECTING DEVICE FOR MONEY OR EQUIVALENTS

This invention relates to a detecting device, and more particularly to a supply detecting device for money or equivalents capable of determining the presence thereof within a container, especially an opaque container.

BACKGROUND OF THE INVENTION

Even with the advent of the computer age and the cashless society, it is still very desirable to have access to cash or equivalents thereof. If this can be accomplished by a machine, with minimal interaction between two human beings. In other words, it can be quite helpful if most of the dispensing of the cash or equivalents can be accomplished by a machine.

While the machine is supplied with cash or equivalents by a human, dispensing from that machine may be accomplished by machine interaction with the eventual user of the cash or equivalents. Such dispensing is done by a code or a series of codes. For example, when the machine is an automatic teller machine, a magnetic striped card is inserted, followed by entry of a personal code with a voice signal or a tactile source. If the proper steps are followed, the person can receive cash or other material contained therein.

Various coin operated machines are affected by the quantity of coins contained therein. Each coin-operated machine has at least one coin box contained therein. Such a coin box is securely supported within the machine, in order to provide limited access thereto. Many times, it very desirable to determine a quantity of coins therein, without visually inspecting the coin box.

By determining the quantity is meant obtaining an estimate of coins therein. In a typical coin operated vending machine, if the coin box is too full, the machine will not operate, and sales can be lost. It is very desirable to determine a too full coin level, without exposing the coin box.

In a typical coin operated gambling device, there may be one coin box, which handles both pay outs and receipts. There may also be two coin boxes, a first box which handles the pay outs and a second box which handles the receipts. If the first box is too full or the second box too empty, the machine will not operate properly, and business can be lost.

Alternatively, if the machine is a gaming machine, such a slot machine, the dispensing code is randomly determined, when that machine is played in a proper fashion. When a dispensing code, also known a winner code comes up, a bin or other container dispenses a thus determined amount set by such a code.

Whatever item of value is contained in those machines, it is extremely necessary for the machine to be secure. It is also necessary to determine whether there is an adequate amount of the desired items of value contained within the machine. Security and determination of that adequate amount work against each other. Both have mutually exclusive properties, which are also mutually interfering. It very desirable to maximize both goals, while minimizing the interference therebetween.

In the gaming industry especially, it is very desirable and even highly critical to be able to determine the level of coins or other rewards at a glance. It is also critical to keep the coins present in the machines, for example a slot machine, concealed, but available. If those coins are concealed, it is hard to check the level thereof.

Within the slot machine is a receiving member for receiving the coins that were put in by gamblers, and a payout bin for paying out the coins to the winners. To receive those coins from the payout bin, the winner depletes the coin supply in the payout bin. It is very desirable to check the coins in the payout bin without having to open the machine. Yet, there is no efficient way to do this at this time.

In a like fashion, the checking of coin levels in a cash register or similar device is very desirable. While, the exact amount or number of coins or equivalents does not have to be known, a relative quantity or supply must be determinable, hopefully without opening the machine.

If, the cash level or coin level in a cash register can be checked in a simple fashion, greater advantages are obtained. An outward check of a concealed coin package is useful. It simplifies the determination of the amount of change required and other appropriate action. If this can be done electronically and in an efficient fashion, it becomes possible to check the system efficiently and keep it supplied efficiently, with fewer personnel.

Metal sensors are known. However, these sensors, which measure the voltage induced by a decaying magnetic field, suffer from inaccuracies due to the varying resistance caused by temperature changes. These devices detect only the presence or absence of coins. Thus, no reliable device exists at this time for solving such problems.

Detection of paper in machines is also desirable. This is true whether the paper is currency, coupons, tickets or other items having a cash value or other value. Since paper does not have inductance, other detecting devices are required. If paper and coins are the different compartments of the same container, providing a detection mechanism for both is difficult to accomplish.

SUMMARY OF THE INVENTION

Among the many objectives of this invention is the provision of a supply detecting device for determining an adequate presence of money or an equivalent.

A further objective of this invention is the provision of a supply detecting device for a coin supply in a closed container.

Yet a further objective of this invention is the provision of a supply detecting device for a currency supply in a closed container by a reflective type photo sensor which is controlled and read by a micro controller.

A still further objective of this invention is the provision of a supply detecting device for a coin supply in a gaming device.

Another objective of this invention is the provision of a supply detecting device for a currency supply in a gaming device.

Yet another objective of this invention is the provision of a supply detecting device for a money supply in a gaming device.

Still, another objective of this invention is the provision of a supply detecting device for a money supply, which is easily stored.

Also, an objective of this invention is the provision of provision of a supply detecting device for a currency supply in an automatic teller machine.

A further objective of this invention is the provision of a supply detecting device for a money supply in an automatic teller machine.

Yet a further objective of this invention is the provision of a supply detecting device for a money supply in a vending machine.

A still further objective of this invention is the provision of a supply detecting device for a coin supply in a closed container by inductance.

Another objective of this invention is the provision of a supply detecting device for a currency supply in a gaming device.

Yet another objective of this invention is the provision of a supply detecting device for a money supply in a gaming device.

Still, another objective of this invention is the provision of a supply detecting device for a money supply, which is easily stored.

Also, an objective of this invention is the provision of provision of a supply detecting device for a currency supply in an automatic teller machine.

These and other objectives of the invention (which other objectives become clear by consideration of the specification, claims and drawings as a whole) are met by providing a supply detecting device for money or equivalents capable of determining the presence thereof within a closed container.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
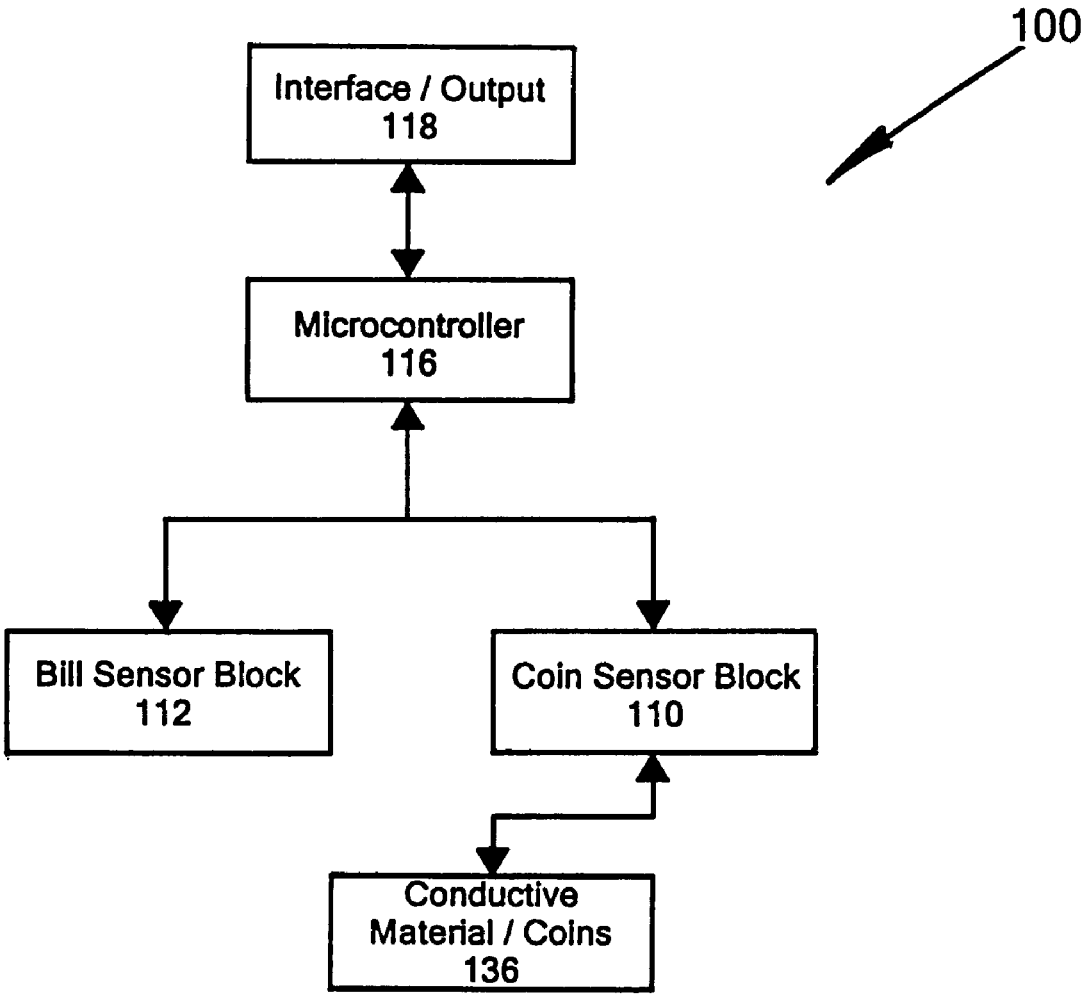
FIG. 1 depicts a coin checking assembly 110 and a currency checking assembly 112 within the supply detecting device 100 of this invention.

With an electronic detecting device cooperating with and being used with a machine containing a money supply; coins, or currency, or equivalents thereof may be detected. While it is possible to determine an exact amount, the purpose is to determine a rough quantity value in order to determine, when resupply is necessary. In this matter, an accurate count of the money supply is not required, so long as an adequate supply may be maintained.

For coins or the like, a conductive proximity center is used to sense the difference in energy absorbed by an inductor from a power source and compare it to the situation when no conductive material is in close proximity and when some conductive material is in close proximity. This application of an inductor is of particular use with coins or other metallic disks, such as tokens.

The coin sensor may be an energy, electromagnetic type sensor based on the inductance or transfer of energy between a coil and the coins. It can also be any other sensor capable of detecting metal. However, the metal detection method of energy, electromagnetic type sensor based on the inductance is preferred. Other suitable types are the reflective photo sensor array or the transmission type photo sensor array.

Presence of paper money or equivalents; such as bills, currency or equivalents thereof; may be accomplished by a variety of sensors. As long as the applicable sensor is connected to an appropriate readout device, the desired result of determining the presence of paper money or equivalents can be obtained.

One way of determining the presence of paper money or equivalents is accomplished by a reflective type photo sensor, which is also controlled and read by the micro controller. The micro controller can read any compartment and determine the presence of bills for example, of a certain level currency. Transmittal of this information to an interface and the to other systems in order to keep a check on this matter is efficiently accomplished with this device.

Determination of the presence of paper money or equivalents may also be accomplished by having a conductive plate in contact with the top member of a stack of bills. The conductive plate cooperates with a bill inductance coil mounted on the bottom of the cash register drawer. As the stack of bills decreases, inductance changes. When a desired inductance is reached, a signal is sent to the output, so that the supply can be replenished.

On the other hand, regarding coin detection, when coins or other conductive equivalents are in close proximity to the inductor, the variable magnetic flux generates eddy currents inside the conductive material. The eddy currents thus produced cause a measurable transfer of energy from the first inductor to the conductor, which are coins in this case.

For a gambling machine, some sort of gambling device is incorporated therein. Operably connected to the gambling device as a part of the gambling machine is a receiving device and a dispensing device. The receiving device receives coins or tokens used by a gambler to activate the machine. The dispensing device dispenses coins to the winners.

With the electronic detecting device as applied it is possible to determine and read the level of coins in both the dispensing device and receiving device. The dispensing device and receiving device are sometimes separate. It is critical to know the level of coins in both areas.

In a like manner, coins in each section of a cash register can be checked by the electronic detecting device attached to each section containing coins. Thus, a central location can monitor the coins in a cash register.

By a coin is meant a metallic disk. Such a disk may be a coin from any country. It may also be a gaming token. Because of the metallic nature of the coins or tokens, and inherent conductivity thereof, the conductivity and inductance thereof are used to determine the relative amount of coins or tokens present.

By a supply is meant a reserve, a determined or an undetermined amount or any other set of money or equivalents contained within a closed or closeable container. It is these containers, which help to secure money or equivalent in the closed container. This money or equivalent may be metallic or paper.

An inductor stores a certain amount of energy in accordance with the current passing through the inductor in the induction of the inductor. This is referred to as the primary inductor. If the primary inductor coupled with the secondary inductor and there is a closed circuit in the secondary inductor, based on the coefficient of coupling between inductors, a certain amount of energy will be transferred to the secondary inductor.

In a container having many compartments, the level of coins in each compartment is monitored. By monitoring, the inductance therein is compared to a reference level. If the level is too low or does not a certain set of empirically determined parameters, a message is sent to the serial interface. When currency is also present therein, which is the paper money level, is monitored and a message is sent out. Each compartment has its individual sensor being monitored by a micro controller. Signals from each micro controller are coordinated to determine the status of such a container. Such containers are typically a cash register drawer and similar containers.

A typical cash register drawer has plurality of compartments. Some compartments act as bill holders. Each bill holder has a spring-loaded holder mounted thereover and are adapted to swing up and down under hand force, in order to permit access to different denominations of currency in each compartment. Each coin denomination has its own compartment or coin box. However, gravity holds the heavier coins in place. Thus for coins the spring-loaded holder is not required.

The measurement of this transfer of force, when coins are being checked, can also be used or set to trigger an indicating device, or indicator, in order to provide an external determination for the presence or absence of a particularly desired amount of coins or tokens present. This determination permits an appropriate adjustment in the amount of coins in a desired position.

Considering FIG. 1, an electronic detecting device for a money supply 100 has coin checking assembly 110 and currency checking assembly 112 feeding rough quantity information to microcontroller 116. Microcontroller 116 then feeds the low level information to interface 118 in order to provide a readout of the information.

Figure 2:
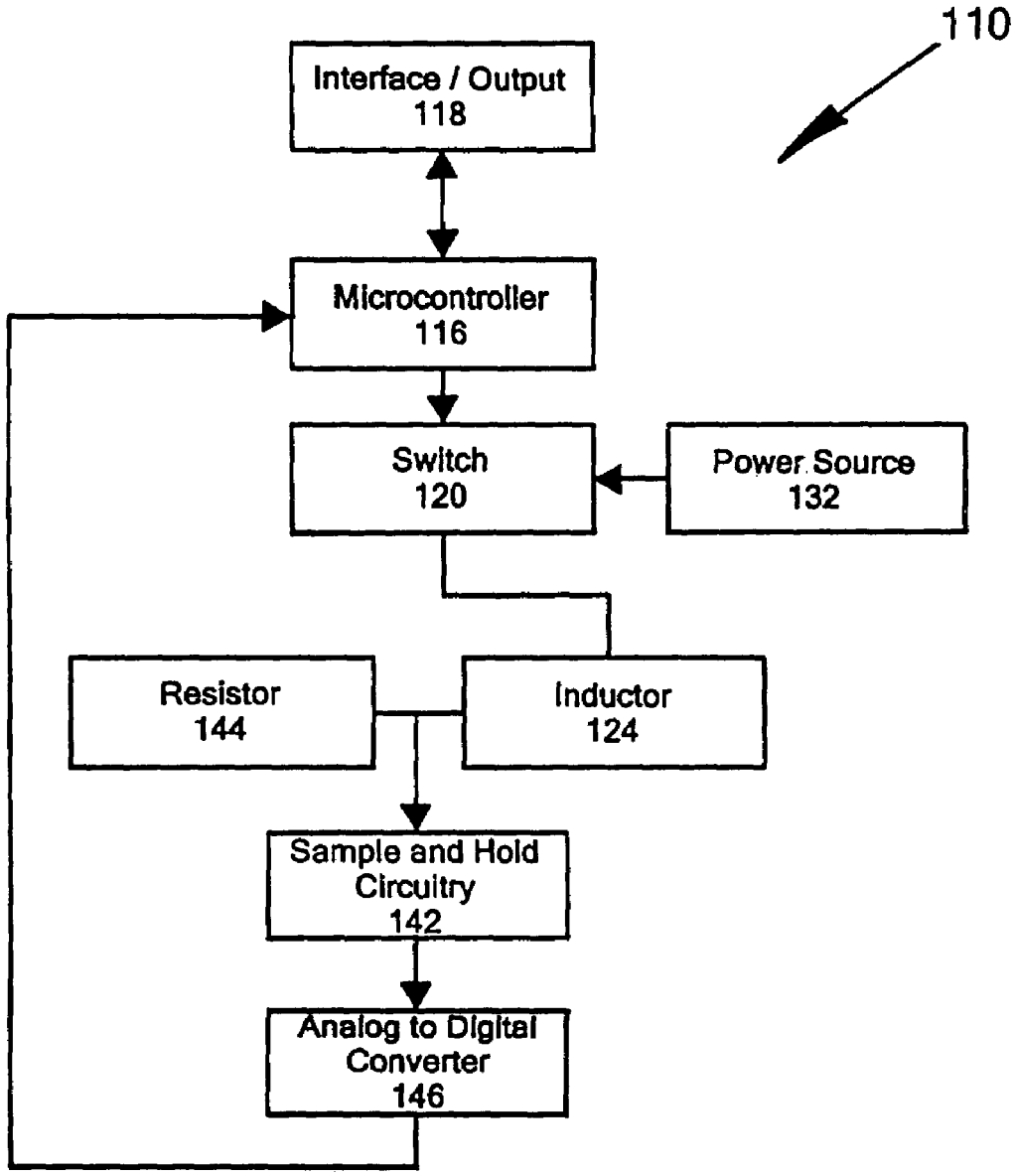
FIG. 2 depicts a block diagram of the coin checking assembly 110 for coins or equivalents capable of determining the presence thereof for the purposes of the supply detecting device 100 of this invention.

Referring now to FIG. 2, within the coin checking assembly 110, the microcontroller 116 is generating a constant period pulse, which will close switch Sw 120 for a time $T_p$, thereby completing a circuit. A desired time $T_p$ may be determined empirically.

With the assumption that there is no conductive object or another inductor in close proximity, the action of turning the switch 120 on will energize the inductor L 124 and the current will start to flow, thereby growing from zero, or nothing, when the pulse starts to the current $I_{pn}$ after a period of time $T_p$ when the pulse ends. The energy absorbed from the power source 132 in this case is:

$$W_p = L^* I_{pn}^2/2 + W_L \qquad \text{Equation 1}$$

Where $L^*I_{pn}^2/2$ represents the energy stored by inductor L 124; $W_p$ represents the total energy transferred from power source 132 with no object made by conductive material or coins 136 (FIG. 1) in the proximity inductor 124. L is the inductance. $I_{pn}$ is the current flowing through the coil 124 and resistor R 144 at the end of time $T_p$ with no object made by conductive material in the proximity thereof. Voltage produced on resistor R 144 by the current flowing therethrough is converted digitally by the analog to the digital converter 146 and read by microcontroller 118.

Figure 4:
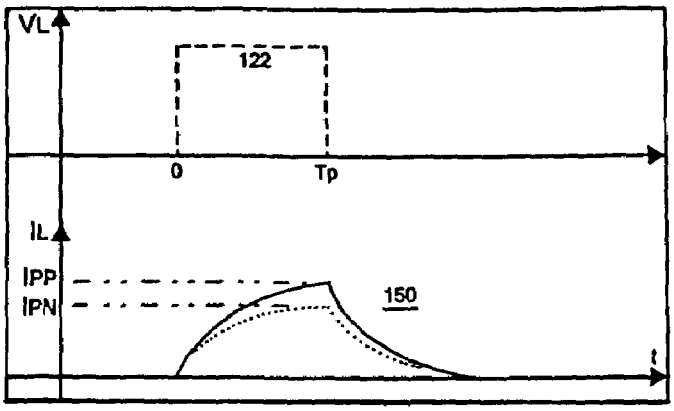
FIG. 4 depicts a diagram in the form of a voltage curve 122 for the coin checking assembly 110 of this invention.

Within Equation 1, $W_L$ represents energy lost as determined by output source. If $W_L$ as energy lost is substituted as the first term of Equation 1, thus permitting Equation 1 to become: $W_{pp}=L'^*I_{pn}^2/2$ or Equation (2); where L' is equivalent inductance, based on the assumption that there is a conductive object in close proximity. In this case the energy absorbed from the power source is determined from the formula set forth in Equation 3:

$W_p=L'^*I_{pn}^2/2+W_t$ (3), where $W_t$ is the energy transferred to the proximity object such as coins. Further assuming that the inductance is constant, if the $W_t$ term from the Equation 3 is incorporated in the first term of the same equation, Equation 3 becomes Equation 4 as follows:

$$W_{pp}=L'^*I_{pp}^2/2 \qquad (4).$$

Where $I_{pp}$ is the inductor current passing through inductor L 124 and resistor R 144 at the end of the pulse in close proximity to a conductive object. A voltage curve 150 similar to that of FIG. 4 is achieved. From a readout based on voltage curve, the need to add coins, currency or equivalents is determined.

Because $W_{pp}$ is different than $W_p$ it follows that $I_{pn}$ is different than $I_{pp}$. By setting $I_{pn}$ as a reference, detecting the current passing through resistor R 144 at the end of time $T_p$ and detecting the difference between these two currents, it can be determined if there is an object made from conductive material or not in the close proximity of the sensor such as proximity object or coins (not shown).

The Sample and Hold circuitry S/H 142 of FIG. 2 will sample and hold the voltage on resistor R 144 at the end of the pulse time $T_p$. The voltage on resistor R 144 is proportional with the current passing through inductor L 124. This voltage is further converted to a digital signal by the analog to digital convertor A/D 146. This value is compared with a reference value stored in the memory of micro-controller 116 and based on the result of this comparison is sending a signal to output circuitry Output 118.

In actual use, or real life, the inductance of inductor 124 is changed also by ferrous materials in the proximity of the inductor 124. This change can be minimized by using an inductor 124 with a core from a magnetic material and by using the right geometry for inductor regarding the application where it is used. The core geometry is determined on an empirical basis on a case by case examination. Also, the effect of changing the coil internal resistance with temperature is minimized by using a large value for the resistor R 144.

Figure 3:
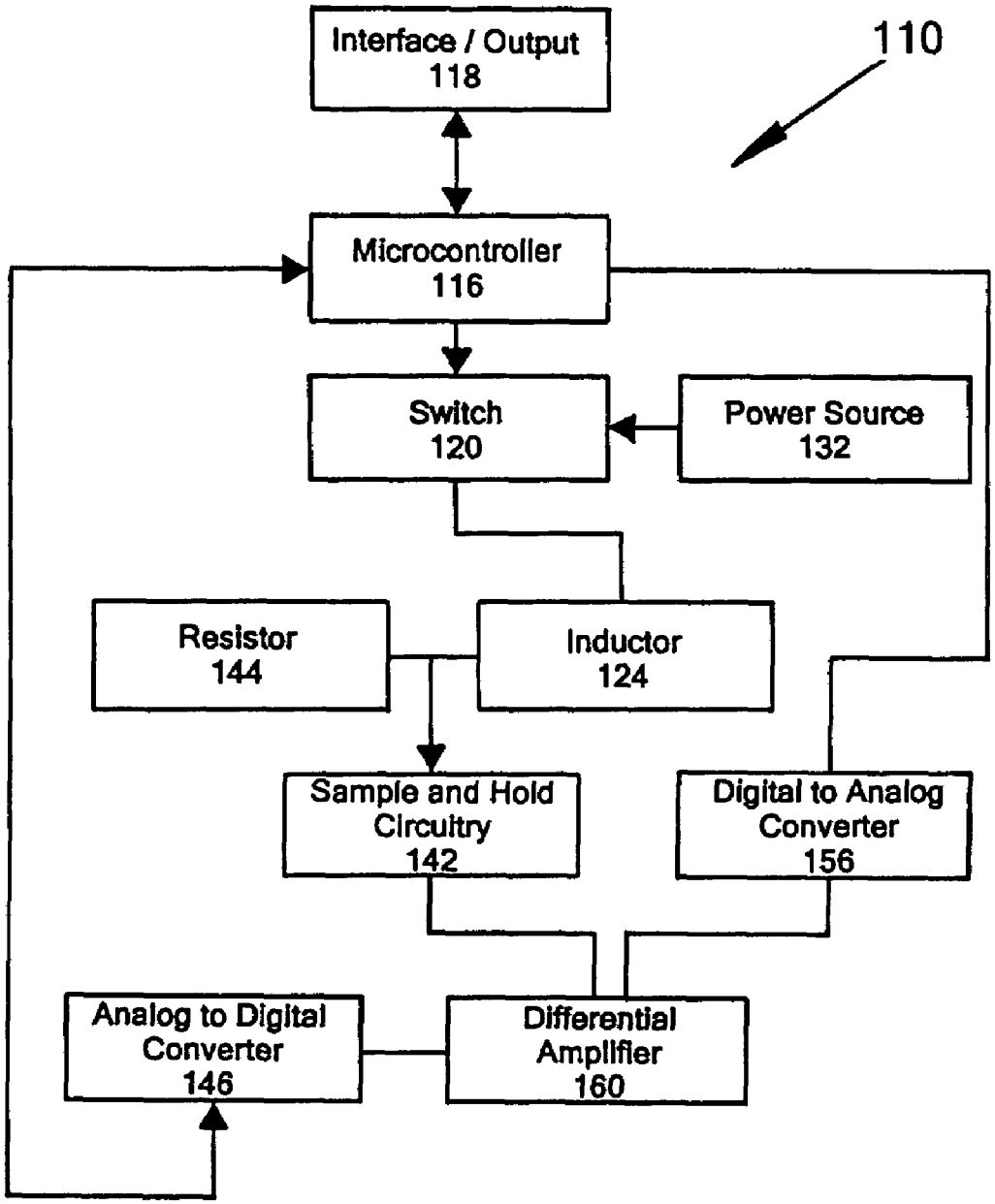
FIG. 3 depicts another embodiment of the coin checking assembly 110 of FIG. 2.

FIG. 3 shows another way to detect proximity very similar with the first method and allow to achieve better sensitivity.

Microcontroller 116 is generating a reference, which is then converted to voltage by the analog to digital converter D/A 156. This reference can be the same as the voltage value after sample and hold circuitry S/H 142 in a situation when there is no object in the close sensitivity of the sensor, or can be another value close enough to the measured value to keep the differential amplifier 160 in range.

Differential amplifier 160 is amplifying the difference in voltage between the measured value and the reference value generated by microcontroller. The result is converted to digital by the analog to digital convertor A/D 146, and then analyzed by microcontroller 116, which then sends the signal to Output 118.

FIG. 4 shows the waveform for current through resistor R 144 and inductor L 124 for circuitry with and without an object made by conductive material in the proximity of the inductor L 124.

Figure 5:
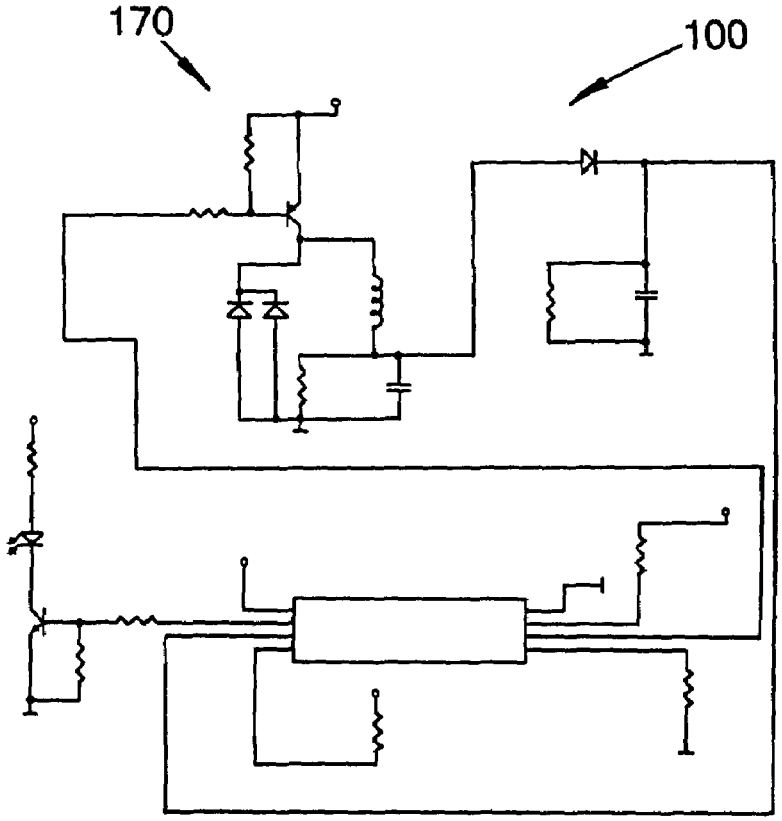
FIG. 5 depicts a circuit diagram 170 for the coin checking assembly 110 of this invention.

FIG. 5 presents an electrical schematic or circuit diagram 170 associated with block schematic set forth in FIG. 2. FIG. 1 depicts the coin checking assembly 110 and currency checking assembly 112 within the supply detecting device 100 of this invention.

Figure 6:
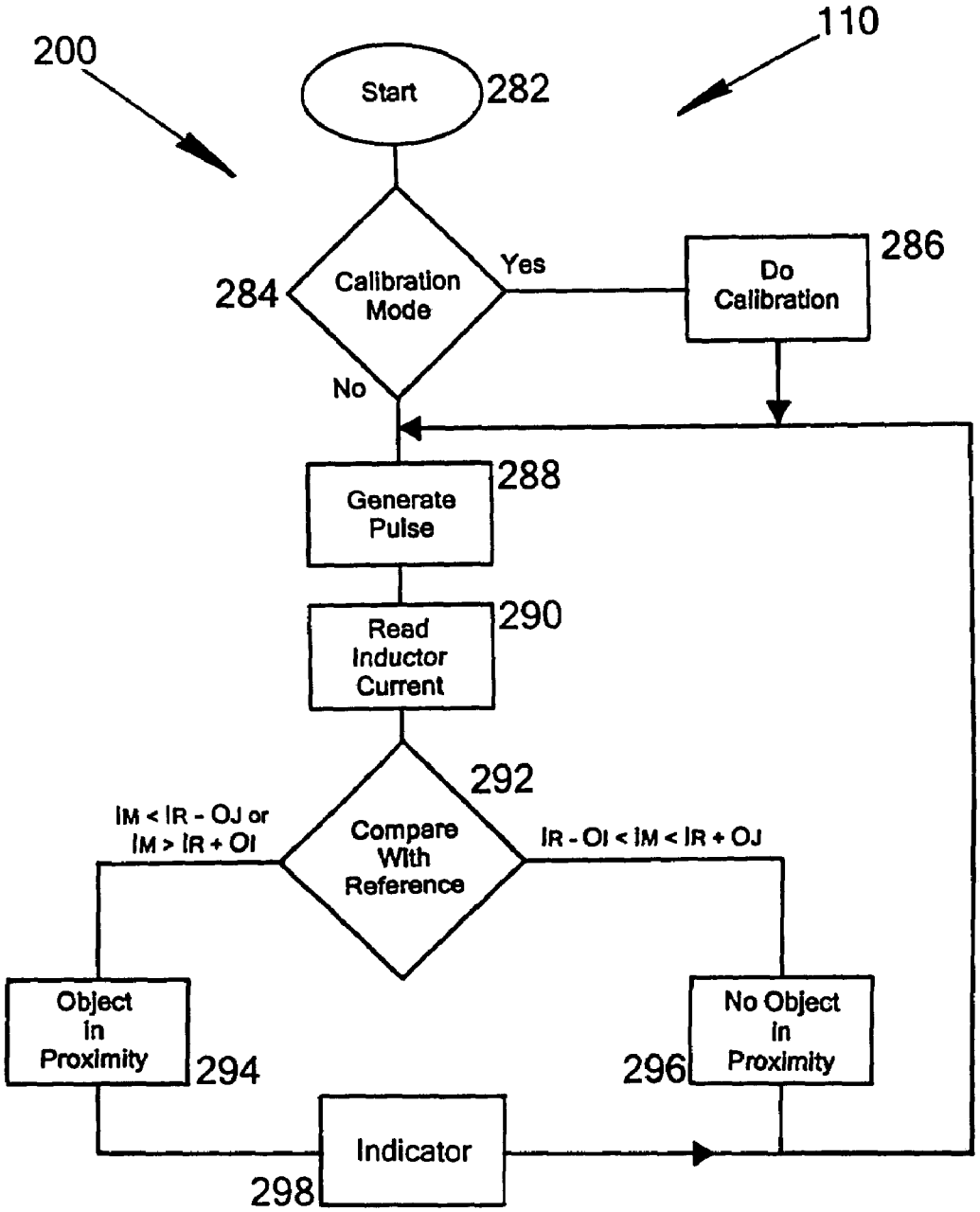
FIG. 6 depicts an operational block diagram 200 for the coin checking assembly 110 of this invention.

FIG. 6 presents a block operational mode 280 for FIG. 2. Start switch 282 activates a calibration mode 284 and funnels it through a corrected calibration system 286 if required. At that point, a pulse 288 is generated to produce read of inductor current 290. Induction current 290 is compared with a base current 292. A comparison therebetween determines objects or object in proximity 294, or no objects or object in proximity 296. Object in proximity 296 activates an indicator 298, which, in turn, cycles back to calibration mode 284, corrected calibration system 286 if required and pulse 288.

Figure 7:
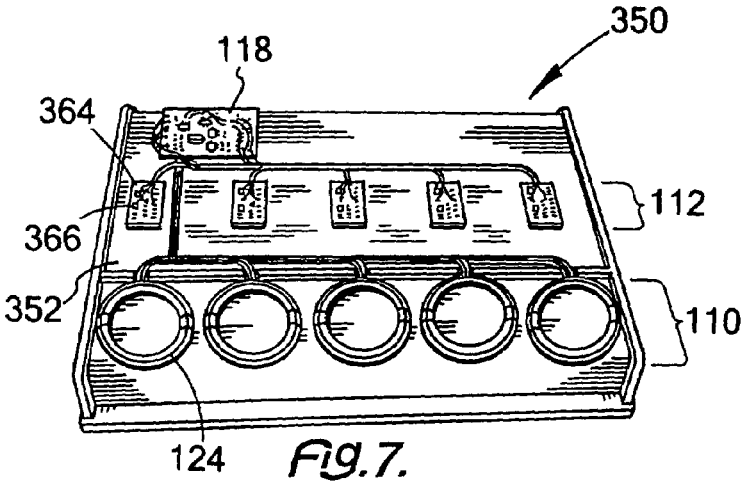
FIG. 7 depicts a bottom perspective view of a standard cash register drawer 350 having operably connected thereto the supply detecting device 100 of this invention operably connected thereto.
Figure 8:
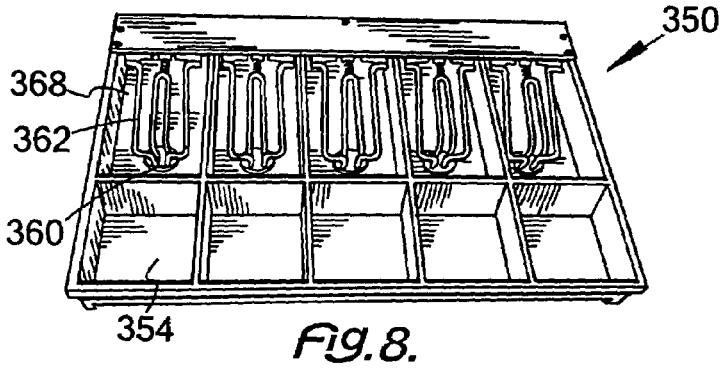
FIG. 8 depicts a top perspective view of a standard cash register drawer 350 based on FIG. 8.

Considering FIG. 7 and FIG. 8, a standard cash register drawer 350 has operably connected thereto a supply detecting device 100 of this invention with coin checking assembly 110 and a currency checking assembly 112. Inductor coil 124 on the bottom 352 the cash register drawer 350 at each coin box 354 therein, within the cash register drawer 350 and is wired in a standard fashion to the interface output 118. Interface output 118 receives the output from the inductor 124, which output can then be read in any suitable fashion in order to determine when it is desired to add more coins.

Figure 9:
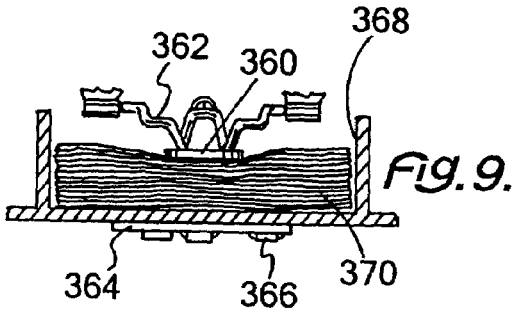
FIG. 9 depicts a side cross-sectioned view of currency checking assembly 112 for a standard cash register drawer 350 based on FIG. 8.

Adding FIG. 9 to the consideration, currency checking assembly 112 for a standard cash register drawer 350 has a conductive plate 360 mounted on the spring-loaded bill holder 362 for each currency compartment 368 in the cash register drawer 350. Conductive plate 360 cooperates with the bill coil 364. Bill coil 364 is connected to bill proximity detector circuit 366. Proximity detector circuit 366 feeds interface output 118 and provides a readout on the currency present in each currency compartment 368 having bill supply 370.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A supply detecting device for money or equivalents comprising:

(a) a bill sensor being controlled and readable by a micro controller in order to form a bill output, (b) the bill sensor being located along a currency storage container;

(c) an inductive proximity sensor being controlled and read by the micro controller in order to form a coin output;

(d) the inductive proximity sensor being located on a coin storage container; and (e) the coin output and the bill output from the micro controller being sent to a read-out means.

2. The supply detecting device for money or equivalents of claim 1 further comprising:

(a) a voltage source;

(b) a primary inductor located adjacent to the coin storage vessel;

(c) a reference inductor located away from the coin storage vessel;

(d) a switch to initiate and terminate the voltage supply to the inductor and reference inductor; and (e) a signal handling circuit.

3. The supply detecting device for money or equivalents of claim 2, further comprising:

(a) a digital to analog signal controlled by the micro controller;

(b) a differential amplifier accepting input from the signal handling circuitry;

(c) the differential amplifier accepting input from the digital to analog converter;

(d) an analog to digital converter accepting input from the differential amplifier; and (e) the analog to digital converter proving input to the microprocessor.

4. The supply detecting device for money or equivalents of claim 3 further comprising:

(a) the signal handling circuitry accepting input from primary inductor; and (b) the signal handling circuitry accepting input from the reference inductor.

5. The supply detecting device for money or equivalents of claim 4 with the inductive proximity sensor further comprising the switch being controlled by the micro controller.

6. The supply detecting device for money or equivalents of claim 5 further comprising:

(a) the bill sensor being selected from the group consisting of a bill photo sensor and a bill inductance sensor; and (b) the bill sensor providing an indication for resupply.

7. The supply detecting device for money or equivalents of claim 6 further comprising:

(a) the bill inductance sensor being mounted on a bill holder of a cash register drawer;

(b) the inductive proximity sensor being mounted on a coin box of the cash register drawer;

(c) the bill inductance sensor having a bill inductance coil on the bottom of a bill holder and a conducting member on a top of the bill holder.

8. The supply detecting device for money or equivalents of claim 7 further comprising:

(a) the cash register drawer having a plurality of the bill holder;

(b) the cash register drawer having a plurality of the coin box;

(c) each member of plurality of the bill holder having one of the bill inductance sensor associated therewith; and (d) each member of plurality of the coin box having one of the inductive proximity sensor associated therewith.

9. A method of detecting an amount of coins contained in a vessel by comparing the difference in current between a primary inducer placed next to the coin vessel and a reference inducer placed away from the coin vessel with a stored reference value.

10. The method of claim 9 further comprising a micro controller activating a switch to connected between a voltage supply and the primary and reference inductors to induct the inducer.

11. The method of claim 10 further comprising a signal handling circuit accepting output from the primary and reference inductors and outputting the difference.

12. The method of claim 11 further comprising a differential amplifier accepting the output from the signal handling circuit and the analog output from a digital to analog converter to amplify the signal.

13. The method of claim 12 further comprising an analog to digital converter accepting the analog output from the differential amplifier and converging it to digital.

14. The method of claim 13 further comprising the micro controller accepting in the input from analog to digital controller and outputting it to a reading mechanism.

15. The method of claim 14 further comprising the reading mechanism comparing the output from the micro processor to a stored reference value to determine the level of coins in the coin vessel.

16. A supply detecting device for metal money or an equivalent for metal money comprising:

(a) an energy, electromagnetic type sensor, which is controlled and read by a micro controller;

(b) the energy, electromagnetic type sensor having a voltage source, a primary inductor, a reference inductor, a switch, and a signal ban sensor being located along a side of a coin storage container;

(c) the voltage source serving the energy to the electromagnetic type sensor;

(d) the primary inductor located adjacent to the coin storage vessel;

(e) the reference inductor located away from the coin storage vessel;

(f) the switch to initiate and terminate the voltage supply to the primary inductor and the reference inductor;

(g) the signal handling circuit providing an output from the energy, electromagnetic type device;

(h) the micro controller providing the output from the energy, electromagnetic type sensor to a read-out means;

(i) the read-out means having an indicator activatable by a determined setting; and (j) the output being adapted to cause the indicator to show the determined setting being reached.

17. The supply detecting device for money or equivalents of claim 16 with the energy, electromagnetic type sensor further comprising:

(a) the signal handling circuitry accepting input from primary inductor; and (b) the signal handling circuitry accepting input from the reference inductor.

18. The supply detecting device for money or equivalents of claim 17 with the energy, electromagnetic type sensor further comprising the switch being controlled by the micro controller.

19. The supply detecting device for metal money or an equivalent for metal money of claim 16 with the energy, electromagnetic type sensor further comprising:

(a) a digital to analog signal controlled by the micro controller;

(b) a differential amplifier accepting input from the signal handling circuitry;

(c) the differential amplifier accepting input from the digital to analog converter;

(d) an analog to digital converter accepting input from the differential amplifier; and (e) the analog to digital converter providing input to the microprocessor.

* * * * *